US006789615B2

(12) United States Patent
Michelfelder et al.

(10) Patent No.: US 6,789,615 B2
(45) Date of Patent: Sep. 14, 2004

(54) HEAT EXCHANGER, IN PARTICULAR FOR SWIMMING POOLS

(75) Inventors: Bernd Michelfelder, Karlsruhe (DE); Bernd Seeger, Pforzheim (DE)

(73) Assignee: Witzenmann GmbH, Pforzheim (DE)

( * ) Notice: Subject to any disclaimer, the term of this patent is extended or adjusted under 35 U.S.C. 154(b) by 7 days.

(21) Appl. No.: 10/376,762

(22) Filed: Feb. 28, 2003

(65) Prior Publication Data

US 2004/0035565 A1 Feb. 26, 2004

(30) Foreign Application Priority Data

Feb. 28, 2002 (DE) ..... 102 08 658

(51) Int. Cl.[7] ..... F28D 7/10
(52) U.S. Cl. ..... 165/163; 165/156
(58) Field of Search ..... 165/156, 163

(56) References Cited

U.S. PATENT DOCUMENTS

| | | | | | |
|---|---|---|---|---|---|
| 1,717,490 | A | * | 6/1929 | Blanding | 165/163 |
| 1,921,259 | A | * | 8/1933 | Olson | 165/163 |
| 1,944,894 | A | * | 1/1934 | Kennedy | 165/163 |
| 3,802,499 | A | * | 4/1974 | Garcea | 165/163 |
| 4,872,503 | A | * | 10/1989 | Marriner | 165/54 |
| 5,131,351 | A | * | 7/1992 | Farina | 122/250 R |
| 2002/0074111 | A1 | * | 6/2002 | Seeger et al. | 165/163 |

FOREIGN PATENT DOCUMENTS

| | | | | |
|---|---|---|---|---|
| DE | 3440060 | | 5/1986 | |
| DE | 3818689 | | 2/1990 | |
| DE | 10051756 | | 5/2002 | |
| EP | 1199536 | A2 * | 4/2002 | F28D/7/02 |
| EP | 1314947 | A2 * | 5/2003 | F28D/7/02 |
| EP | 1347227 | A2 * | 9/2003 | F16L/25/00 |

* cited by examiner

*Primary Examiner*—Allen J Flanigan
(74) *Attorney, Agent, or Firm*—Volpe and Koenig, P.C.

(57) ABSTRACT

A heat exchanger for swimming pools, formed of an essentially cylindrical housing through which a first medium flows axially, while a second medium flows through a conduit that is installed in the housing and that is fashioned as a coil. The coil-shaped conduit is formed of a corrugated hose, and has separate connections for the second medium, or for the corrugated hose. The corrugated hose is connected at its end segments to separate connections for the second medium via a plug connection. The connections extend from the outside to the inside of the housing, passing through the housing.

14 Claims, 1 Drawing Sheet

HEAT EXCHANGER, IN PARTICULAR FOR SWIMMING POOLS

BACKGROUND

The invention relates to a heat exchanger, in particular for swimming pools, formed of an essentially cylindrical housing through which a first medium flows, essentially axially, the housing having, at its axial end faces, connections for connection with adjacent conduit segments for the first medium, while a second medium flows, via two separate connections that extend radially to the housing, through a conduit that is installed in the housing and is formed as a coil, having an axis that extends parallel to or co-incident with the housing axis. The coil-shaped conduit for the second medium is made of a corrugated hose having end segments that run in the radial direction and that are connected to the separate connections for the second medium and are fixed there.

Swimming pool heat exchangers of this sort are used to heat the swimming water, as a first medium, with the aid of a heating water as a second medium, the ratio of the volumes of the streams of swimming water and heating water being on the order of magnitude of approximately 5 to 1. Accordingly, the swimming water flows through the heat exchanger in the axial direction, and thereby flows around the heating water conduit, which is installed in the heat exchanger housing in the shape of a coil in order to enlarge the heat exchange surfaces. In order to obtain a reliable charging of the coil-shaped conduit, a cylindrical displacement element is usually situated inside the coil, and diverts the swimming water stream around the heating water conduit. Such heat exchanger designs are also known for other areas of application, for example also for fuel cooling units, as is disclosed in DE-A 34 40 060. In this prior art, a significant problem in the assembly of the heat exchanger is that the coil-shaped tubular conduit must be welded from the inside—i.e., under very narrow conditions—against a housing opening so as to line up with the separate connections that extend radially on the outside.

As a rule, for the cited swimming pool water applications, the coil-shaped heating water conduit is made of stainless steel, as is the housing. For applications that are particularly susceptible to corrosion, such as for example mineral water or seawater pools, the components are also manufactured from titanium. In general, the design having a coil-shaped conduit and having a displacement element additionally situated mainly inside the coil necessarily results in a relatively large construction volume, with correspondingly heavy weight, and this large construction volume also results in correspondingly high manufacturing costs, due to the use throughout of high-quality materials.

SUMMARY

In view of this prior art, the present invention is based on the object of providing a heat exchanger, in particular for swimming pools, that is distinguished by simplified installation and improved manufacturability.

According to the present invention, this object is achieved in that the separate connections for the second medium extend from the outside to the inside of the housing, passing through the housing, and that the end segments, running in the radial direction, of the corrugated hose in the interior of the housing are connected to the cited separate connections for the second medium, and are fixed there, via a plug connection.

The essential advantage of the inward installation of the connection between the corrugated hose coil and the separate connections for the second medium is that the corrugated hose can be fixed to these inward-protruding separate connections by simple plugging, without requiring a welded connection or a similarly complicated connection method, which would be very difficult in the narrow installation space available in the interior of the housing, or could be achieved only through an additional division of the housing.

The advantages resulting from the present invention are due not only to the plug connection between the corrugated hose and the separate connection, but also to the separate connection that protrudes into the housing, whereby the corrugated hose and the separate connection can overlap over a certain area, which can be exploited on the one hand for mutual sealing, and on the other hand for mutual fixing. The result is a heat exchanger having a considerably reduced assembly and manufacturing expense.

Advantageously, the end segments of the corrugated hose are plugged into the separate connections for the second medium, and are fixed there for example by pins that engage in positively locking fashion in troughs of the corrugation of the corrugated hose. However, the fixing of the corrugated hose in the separate connections is also possible via other fixing means, such as clamps that apply pressure to the corrugated hose in positively locking fashion, locking or gripping elements, and the like, as long as they satisfy the demands and requirements found for example in the present case of application of a swimming pool heat exchanger.

For the plug connection between the corrugated hose and the separate connections, it is particularly recommended that the separate connections for the second medium be fashioned separately from the housing and inserted through openings in the housing, so that during the assembly of the heat exchanger first the corrugated hose coil is brought into the housing, and the separate connections are only then inserted from the outside into the radial housing openings, and finally the plug connection is made between the corrugated hose and the separate connections during the insertion of the separate connections into the housing. As soon as the separate connections are located in the correct end position in relation to the housing, the corrugated hose can be fixed to the separate connections using the previously noted fixing pins.

Various specific embodiments are conceivable for the connection between the separate connections and the housing, such as for example a screw connection. However, because as a rule the separate connections likewise have at their free end, situated at the external side of the heat exchanger, a screw connection for connecting a medium-conducting conduit that is to be affixed thereto, this would entail the risk that the initial tightening moment in the assembly of the medium-conducting conduit to the separate connection would be transmitted not only to the threading involved here, but also to the second threading via which the separate connection is fixed to the heat exchanger housing. For this reason, it is recommended that in the area of connection between the separate connection and the heat exchanger housing there be provided a plug connection, which however should be formed in positively locking, rotationally fixed fashion, in order to receive torsional forces and thus to absorb the mentioned initial torque. This plug assembly can be secured against withdrawal of the separate connections from the housing (similar to the case of the corrugated hose plug connection) by fixing means in the form of fixing pins that apply pressure to the separate connections on the inside of the housing and fix these connections on the housing wall in positively locking fashion, in that the fixing pins abut on the housing inner wall.

In order to secure the mentioned fixing pins for fixing the corrugated hose in the separate connection on the one hand and for the fixing of the separate connection in the housing on the other hand, which pins can usefully be connected with one another in order to simplify the assembly for each separate connection, to prevent falling out during the operation of the heat exchanger, these pins can be fixed in their installed position by screw-in sleeves. The screw-in sleeves can be formed most simply by the connections for the first medium, situated on the front side of the housing.

The cited and required securing against twisting of the separate connections in relation to the housing can be easily achieved by a hexagonal shape, through a knurling or a polygonal shape. The separate connection can have a shoulder or a collar in the noted polygonal shape, while the housing opening should have a collar that abuts thereon in positively locking fashion, at least in some areas.

In addition to the fixing pin for fixing the corrugated hose in the separate connection, it is recommended, as already mentioned, that a sealing element be provided in the overlap area between the corrugated hose and the separate connection, which most simply can consist of at least one O-ring that is plugged onto the associated corrugated hose end segment and that engages in positively locking fashion in at least one corrugation trough, and whose external side, which applies pressure to the radial segment of the separate connections for the second medium, abuts on the inner side of the radial segment. For this purpose, the cited radial segments of the separate connections for the second medium are preferably of a smooth cylindrical construction, in order to form the required tight connection with the sealing element (i.e., preferably, the O-ring).

Moreover, and especially given larger pressure differences between the first and second medium, in order to strengthen the axial fixing of the corrugated hose in the separate connection at least one of the corrugated hose end segments can work together with another fixing means besides the fixing pin. This fixing means can for example create a locking connection through a design having barbs or the like. An additional fixing means can be formed by plugging it onto the corrugated hose in addition to the sealing element, and plugging it into the separate connection together with this sealing element; here the diameter of the fixing means should have, in relation to the diameter of the separate connection, a dimension such that under initial loading it abuts on the inner side thereof, and in addition the fixing means should likewise engage in positively locking fashion in the corrugated hose.

Preferably, the corrugated hose end segment is formed of a corrugated hose section formed by simple cutting to length. However, it is particularly advantageous if the corrugated hose end segment is calibrated through stretching and is reduced somewhat in flexibility, so that it does not give way in the axial direction by compression during insertion into the separate connection.

In addition, however, the end segment of the corrugated hose can also be formed by a smooth-walled tube that is attached to the corrugated hose, for example by welding, which tube then enters into the plug connection with the separate connection. For this purpose, on its external side the tube can have groove-shaped recesses into which the O-rings are placed in order to seal the plug connection. According to the present invention, this specific embodiment should be expressly regarded as a variant, falling under the present main claim, of the corrugated hose end segment.

In order to promote the complete surrounding of the corrugated hose coil by the flow, it is especially advantageous if spacing elements are provided between the corrugated hose coil and the inner surface of the housing jacket, via which the first medium, i.e., the swimming pool water in particular, can also flow through this gap area between the housing and the corrugated hose. The spacing elements should be fashioned so as to promote the previously mentioned plugging assembly.

The mentioned spacing elements also have the further advantage that they support the corrugated hose, in order to enable the prevention of flow-induced noise emissions. In connection with this, it should also be noted that it can be worthwhile, not only in order to improve the flow around the coil but also in order to prevent noise resulting from flow, to install one or more flow-past elements, in the form of baffle plates, in the housing and in the corrugated hose coil.

A particular advantage of the simplified installation of the heat exchanger according to the present invention, and also of the circumstance that the separate connections are not connected in one piece with the housing, but rather are fashioned separately from the housing, is that only the surfaces that are responsible for the heat exchange, i.e. the corrugated hose, must be manufactured from special steel, while the housing can be made of corrosion-resistant plastic. Thereby the costs of the heat exchanger according to the present invention can additionally be drastically reduced. In contrast, in the prior art it was necessary to weld the coil-shaped conduit to the housing in the area of the radial openings and to bring it into connection with the radial connections, so that the housing also required a weldable, corrosion-resistant material, i.e. in particular special steel. In contrast, in the heat exchanger according to the present invention the connection of the corrugated hose and the separate connection can take place through plugging assembly and without welding; and, if it were to be desired likewise to manufacture the separate connection from special steel, the entire housing could still be made of plastic, thus still enabling a significant cost reduction. As a plastic material, in particular PA, PP, PE, PVC-C, and similar materials are possible.

Accordingly, in this case as a rule the first medium is formed by the swimming pool water, while the second medium is formed by the heating medium, or the heating water. Likewise, the present heat exchanger can however also be used for the cooling of fluids; here the second medium must then have a temperature that is reduced in relation to the fluid temperature. In addition, it is of course also possible to use the heat exchanger for other combinations of media, for example in order to heat water for industrial use in gas water heaters, fuel cells, and the like, for the recovery of waste heat, and in general for a large number of industrial applications in the automotive field, etc.—even in areas where heat exchangers having a design with a cooling or heating coil have customarily been used.

In comparison with heat exchangers from the prior art (not all of which enjoy prior publication), the subject matter of the present invention has the advantage that, in a heat exchanger that due to the required volume throughput can have connections for only one medium at its end face, the second medium is conducted into the heat exchanger via radial connections, and there can be transported via a corrugated hose coil having a maximum length, and thus a maximum surface responsible for the heat exchange. That is, no transition areas such as bends or the like are required that create the connection between the corrugated hose and the connections situated on the outside of the housing, and that usually cause a large pressure loss due to abrupt changes in the direction of flow, and also cause reduced exchange efficiency due to their separate length that is not to be used for the heat exchange. In contrast to this, in the subject matter of the present invention, in which the corrugated hose goes over directly into the separate connections for the second medium, there results a significantly reduced pressure loss, or an improved heat exchange efficiency, in comparison with heat exchanger designs having comparable dimensions. In addition, the omission of the welded connection of the metal components enables the use of a greatly simplified connecting technique with regard to the connection of the corrugated hose to the separate connections, and, with regard to the connection between the heat exchanger housing and the separate connections, allows the two objects to be manufactured from different materials, so that the housing can then be made of inexpensive plastic.

BRIEF DESCRIPTION OF THE DRAWINGS

Additional features and advantages of the present invention result from the following description of an exemplary embodiment on the basis of the drawings.

DETAILED DESCRIPTION OF THE PREFERRED EMBODIMENTS

Figure 1:
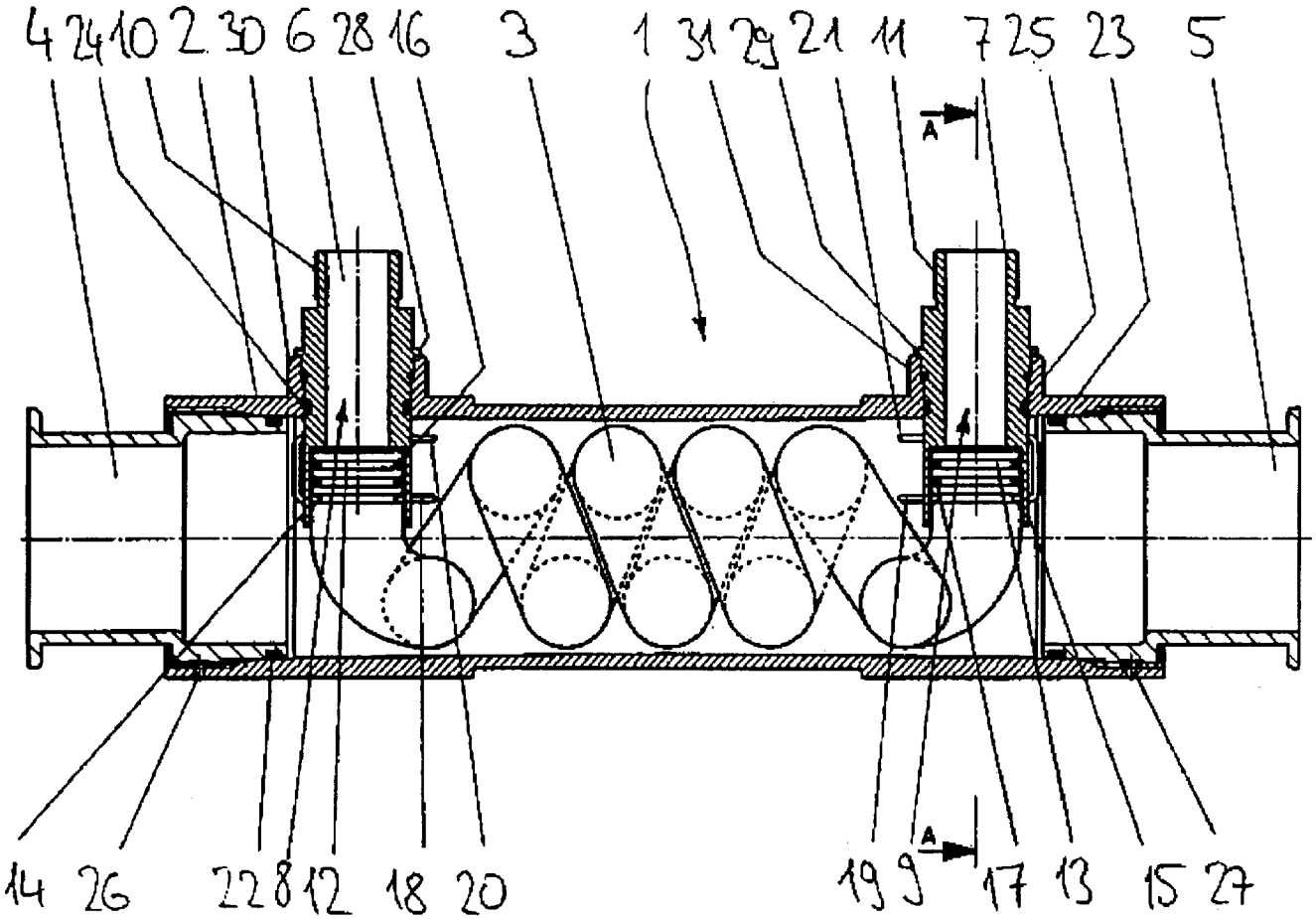
FIG. 1 shows a heat exchanger according to the present invention in a sectional side view.

Heat exchanger 1 shown in FIG. 1 is made up of an approximately cylindrical housing 2 and a corrugated hose coil 3 installed in the housing. While a first medium, in the present case of the swimming pool heat exchange—the swimming pool water, flows into or out of the interior of the housing via axial connections 4, 5, a second medium, in the present case—heating water, flows through corrugated hose coil 3. The corrugated hose 3 is connected to two separate connections 6, 7 that are led through openings 8, 9 in the housing of the heat exchanger and that protrude outward radially, where they can be connected to adjacent conduit segments via external threadings 10, 11.

The connection of corrugated hose end segments 12, 13 with end segments 14, 15 of separate connections 6, 7 takes place through mutual plugging, with a sealing element 16, 17 in the form of at least one O-ring being situated between the corrugated hose and each separate connection. The sealing element engages in positively locking fashion in at least one corrugation situated at the end of the segment.

Each corrugated hose end segment 12, 13 is fixed in end segments 14, 15 of the separate connections 6, 7 via two fixing pins 18, 19 that engage mutually opposed sides of the corrugated hose and that engage in a corrugation trough of an end corrugation from the outside, and that are guided through openings in the end segments of the separate connections.

The separate connections 6, 7 are inserted into openings 8, 9 of the heat exchanger housing from the outside, and are there each likewise fixed in the final position via two fixing pins 20, 21. In order to simplify the assembly, each of these fixing pins 20, 21 is connected in one piece with one of the fixing pins 18, 19 for fixing the corrugated hose coil.

The fixing pins are held in their position via screw-in sleeves that are formed by the connections 4, 5 for the first medium, and that are screwed onto the ends of the heat exchanger housing in the axial direction.

The assembly of the heat exchanger 1 takes place in the following steps: the coil 1 is inserted into the cylindrical housing 2; the separate connections 6, 7 are placed into the housing openings 8, 9 from the outside and are plugged onto the end segments 12, 13 of the corrugated hose coil; subsequently, the corrugated hose coil is affixed onto the separate connections, and the separate connections are fixed in the heat exchanger housing, through the fixing pins 18, 19, or 20, 21, and the screw-in sleeves 4, 5 are screwed into the housing at both end faces in order to hold the fixing pins in position.

Figure 2:
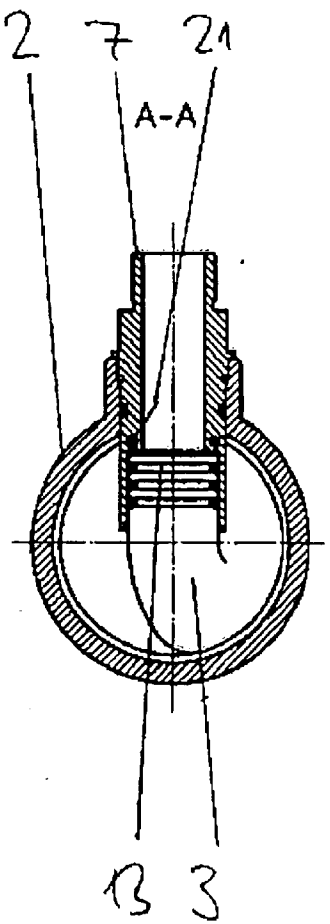
FIG. 2 shows the heat exchanger from FIG. 1 in section taken along the line A—A in FIG. 1.

Moreover, from FIG. 1 and 2 the position of additional sealing rings can be seen: the screw-in sleeves 4, 5 are sealed against the heat exchanger housing via O-rings 22, 23, and the separate connections are sealed against the heat exchanger housing via O-rings 24, 25. After being screwed in, the screw-in sleeves 4, 5 are fixed so as to be secure against twisting on the heat exchanger housing via rivets 26, 27. The separate connections 6, 7 have a stop collar that limits the insertion of the separate connections into the housing openings 8, 9. Beneath (in relation to FIG. 1 or FIG. 2) this stop collar 28, 29, there is a shoulder of the separate connections in the form of a hexagon, via which the separate connections are fixed, so as to be secure against twisting, in a collar 30, 31 that protrudes radially from housing openings 8, 9, in that this radially protruding collar 30, 31 is fashioned so as to fit onto the hexagonal shape of the separate connections.

To summarize, the present invention offers the advantage of providing a heat exchanger for various applications, and in particular for swimming pools, having a significantly reduced weight, a significantly reduced construction volume, and accordingly reduced manufacturing costs, which can be further lowered in that the housing and the separate connections can be manufactured from inexpensive plastic. Moreover, the heat exchanger according to the present invention is distinguished by a highly simplified assembly, because the corrugated hose can be affixed onto the separate connections through simple plugging.

What is claimed is:

1. Heat exchanger, comprising a generally cylindrical housing (2) through which a first medium flows, generally axially, the housing having at axial end faces connections (4, 5) for connection with adjacent conduit segments for the first medium, two separate connections (6, 7) that extend radially to the housing for a second medium to flow through a conduit (3) that is installed in the housing and that is formed as a coil, having a coil axis that runs parallel to or identically with an axis of the housing, the coil-shaped conduit for the second medium comprising a corrugated hose (3) having end segments (12, 13) that extend in a radial direction and that are connected to the separate connections for the second medium, wherein the separate connections (6, 7) for the second medium extend from an outside to inside of the housing, passing though the housing (2), and the end segments (12, 13) of the corrugated hose (3), that extend in the radial direction, in an interior of the housing are connected to the separate connections for the second medium, and are fixed there, via a plug connection.

2. Heat exchanger as recited in claim 1, wherein the end segments (12, 13) of the corrugated hose (3) are plugged into the separate connections (6, 7) for the second medium, and are held there by fixing means that are positively locking or non-positively locking.

3. Heat exchanger as recited in claim 2, wherein the fixing means comprise pins (18, 19), clamps, or locking elements that engage in positively locking fashion in a corrugation trough of the corrugated hose (3).

4. Heat exchanger as recited in claim 1, wherein the separate connections (6, 7) for the second medium are formed separately from the housing (2), and are inserted through housing openings (8, 9).

5. Heat exchanger as recited in claim 4, wherein the separate connections (6, 7) for the second medium are inserted from the outside into the housing openings (8, 9) of the housing (2), and are fixed there via fixing means (20, 21).

6. Heat exchanger as recited in claim 5, wherein the fixing means (20, 21) for the fixing of the separate connections (6, 7) in the housing (2) comprise fixing pins (20, 21) that are situated on the inside of the housing and that apply pressure there to the separate connections.

7. Heat exchanger as recited in claim 1, wherein the separate connections (6, 7) for the second medium are fixed in positively locking fashion, so as to be secure against twisting, in the housing openings (8, 9) of the housing (2).

8. Heat exchanger as recited in claim 1, wherein the corrugated hose end segments (12, 13) are sealed against the separate connections (6, 7) for the second medium by a sealing element (16, 17).

9. Heat exchanger according to claim 8, wherein the sealing element (16, 17) is formed of at least one O-ring that is plugged onto the associated corrugated hose end segment (12, 13) and engages in positively locking fashion in at least one corrugation trough, and having an outer side, which applies pressure to a radial segment (14, 15) of the separate connections (6, 7) for the second medium, abuts on an inner side of the radial segment.

10. Heat exchanger according to claim 1, wherein the corrugated hose end segments are calibrated by stretching.

11. Heat exchanger according to claim 9, wherein the radial segments (14, 15), to which pressure is applied by the corrugated hose (3), of the separate connections (6, 7) for the second medium are formed as smooth cylindrical sections.

12. Heat exchanger according to claim 1, wherein the corrugated hose (3) and/or the separate connections (6, 7) for the second medium are made of metal.

13. Heat exchanger according to claim 1, wherein the housing (2) and/or the connections (4, 5) for the first medium are made of plastic.

14. Heat exchanger according claim 1, wherein the first medium is swimming pool water, and that the second medium is heating water.

* * * * *